US005115769A

United States Patent [19]

Fiorini

[11] Patent Number: 5,115,769

[45] Date of Patent: May 26, 1992

[54] VIBRATOR

[75] Inventor: Emilio Fiorini, 1890 Valley Farm Road, Penthouse 10, Pickering, Ontario, Canada, L1V 6B4

[73] Assignees: Emilio Fiorini, Stouffville; Enzo Polsinelli, Richmond Hill, both of Canada

[21] Appl. No.: 636,247

[22] Filed: Dec. 31, 1990

[51] Int. Cl.[5] ..... A61H 1/00
[52] U.S. Cl. ..... 128/32; 128/36
[58] Field of Search ..... 128/32, 36, 35, 45, 128/46, 76 R

[56] References Cited

U.S. PATENT DOCUMENTS

| | | | |
|---|---|---|---|
| 2,347,554 | 7/1940 | Gothers | 128/36 |
| 3,557,781 | 1/1971 | Kaye | 128/36 |
| 4,841,954 | 6/1989 | Kalsi | 128/32 |
| 4,920,466 | 4/1990 | Liu | 128/32 |

FOREIGN PATENT DOCUMENTS

| | | | |
|---|---|---|---|
| 8801500 | 7/1988 | World Int. Prop. O. | 128/32 |

*Primary Examiner*—Mickey Yu
*Assistant Examiner*—David J. Kenealy

[57] ABSTRACT

A temple massage device has a resilient frame, straps for attachment, temple massaging pads and a vibrator, vibrating in the direction to cause the pads to massage the temples.

9 Claims, 4 Drawing Sheets

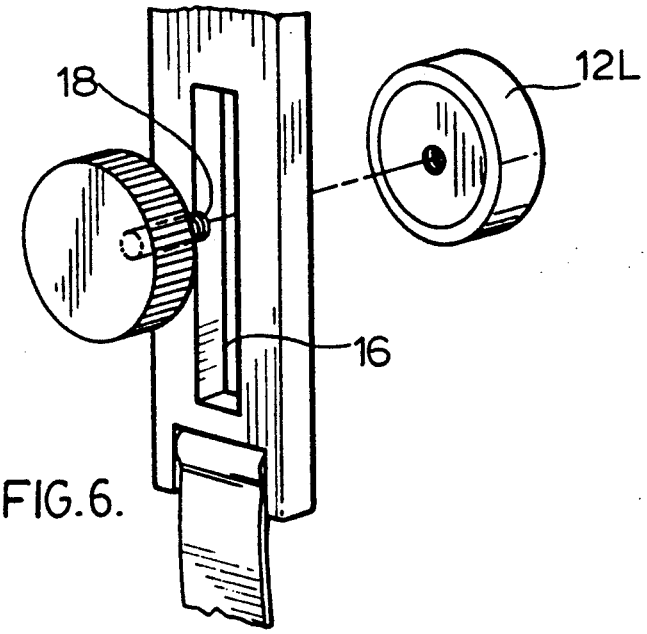
FIG.6.
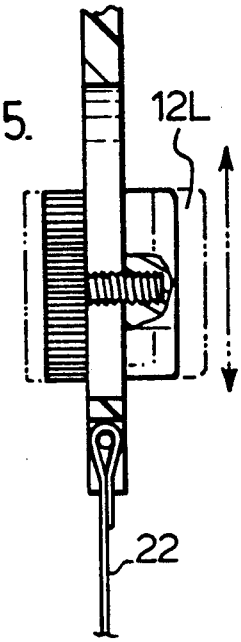
FIG.5.
FIG.8.
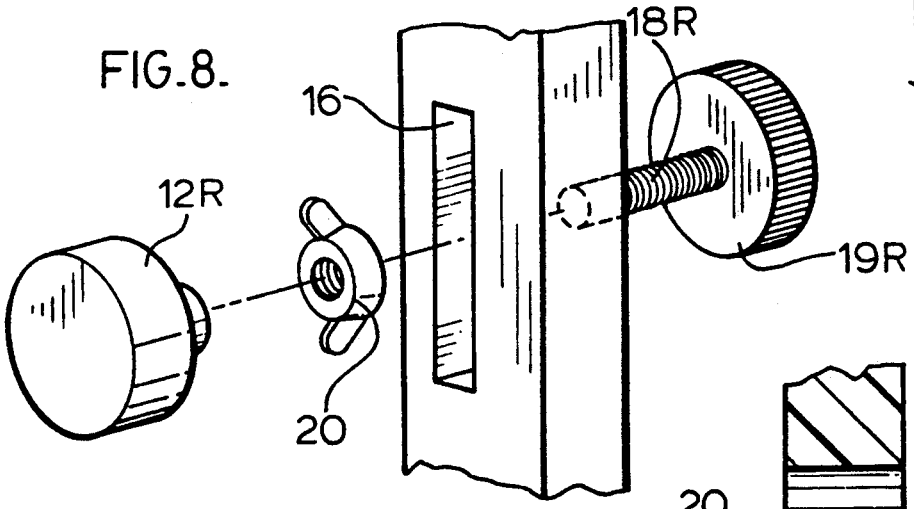
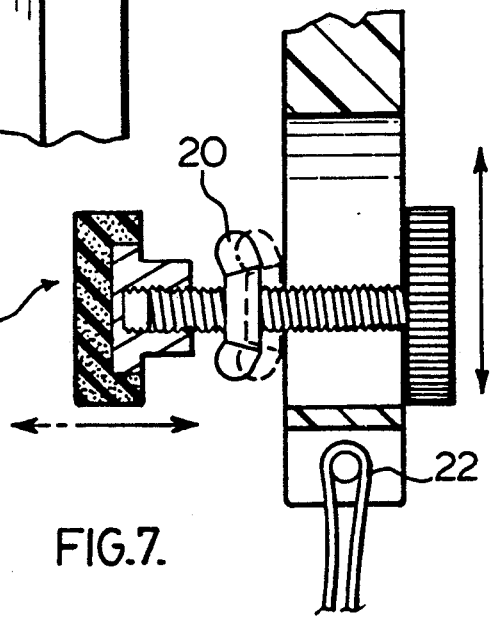
FIG.7.

VIBRATOR

This invention relates to a device for providing vibratory contact to the temple areas of a wearer to provide a vibrating or massaging effect to relieve headache and stress.

There have been a large number of patents which dealt with vibratory appliances for relieving stress, tension and headache. These include the following U.S. patents: U.S. Pat. No. 3,886,934, Doty; U.S. Pat. No. 4,052,981, Bachmann; U.S. Pat. No. 4 343,303, Williams; U.S. Pat. No. 3,763,853, Jochimski; U.S. Pat. No. 4,841,954, Kalsi; U.S. Pat. No. 2,347,554, Gothers; U.S. Pat. No. 2,574,945, Werner; U.S. Pat. No. 3,478,736, Roberts.

Of these the most relevant to this invention appear to be U.S. Pat. Nos. 4,841,954 to Kalsi and 3,478,736 to Roberts.

The Kalsi patent provides vibration caused by rotation about an axis transverse to the head but has a pendulous vibrator and does not provide three point contact with the head including temple contacting members nor a vibration transmitting frame. The Kalsi patent fails to provide numberous other features of applicant's invention which features will be pointed out hereafter.

The Roberts patent provides vibration caused by rotation about an axis transverse to the head but does not provide a vibration transmitting frame, a three point contact including temple contacting areas and in fact provides a separate vibrating means in each temple contact pad. The Roberts patent fails to provide numerous other features of applicant's invention which features will be pointed out hereafter.

This invention provides a resiliently bendable frame designed to extend around the front of the head and a strap to maintain it in position. The bendable frame is made of material with sufficient rigidity to transmit vibration. A single rotary vibration means is provided adapted to vibrate the frame in directions radial to an axis transverse relative to the head of the wearer. A three point contact is provided comprising a resilient pad for location centrally of the forehead and a pad for location over each temple. The combination of the direction of vibration together with the location of the three pads means that the forehead acts as a datum and the central pad expands and contracts with the vibration while the temple pads vibrate in a closed curve roughly parallel to and in contact with the temples to give an effect which has been found to be beneficial and to reduce tension and diminish or remove headaches.

In a preferred version of the invention referred to in the previous paragraph the resilient central pad is of relatively softer material which is partially compressed when the strap attaches the device in place while the temple pads are of relatively harder material to transmit the frame vibrations to the temples while the forehead acts to some extent like a stationary datum.

In a preferred version of the invention referred to above the temple pads are adjustable longitudually along the frame to provide proper temple contact to suit the individual characteristics of the wearer.

In preferred version of the invention referred to above the distance between the temple pads is adjustable transversely to provide proper spacing and pressure having regard to the resiliency of the frame and the requirements and individual characteristics of the user.

In a preferred version of the invention a control for the speed of the rotary vibrating means is provided accessible to the wearer to set the frequency and amplitude of vibrating.

The vibrator and battery power therefor are self-contained for convenience and the vibrator mechanism is contained within the frame for better transmission of vibration to the frame as a whole.

In drawings which illustrate a preferred embodiment of the invention:

FIG. 5 is a sectional view showing the mount for one temple-pad,

FIG. 6 is an exploded perspective view of the components of FIG. 5,

FIG. 7 is a sectional view showing the mount for the other temple-pad,

FIG. 8 is an exploded perspective view of the components of FIG. 7.

Figure 1:
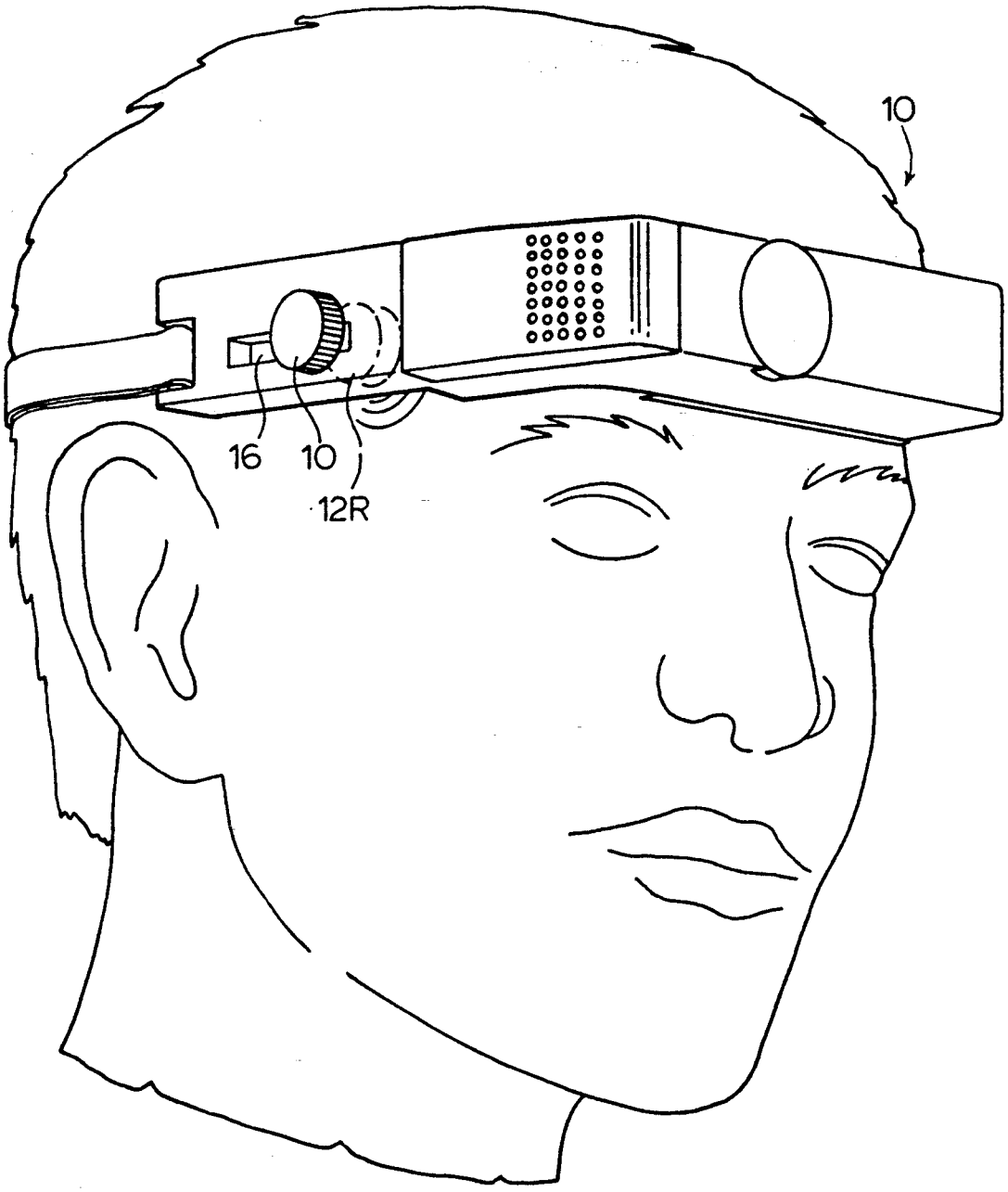
FIG. 1 is a perspective view of the device as worn on the user's head.
Figure 2:
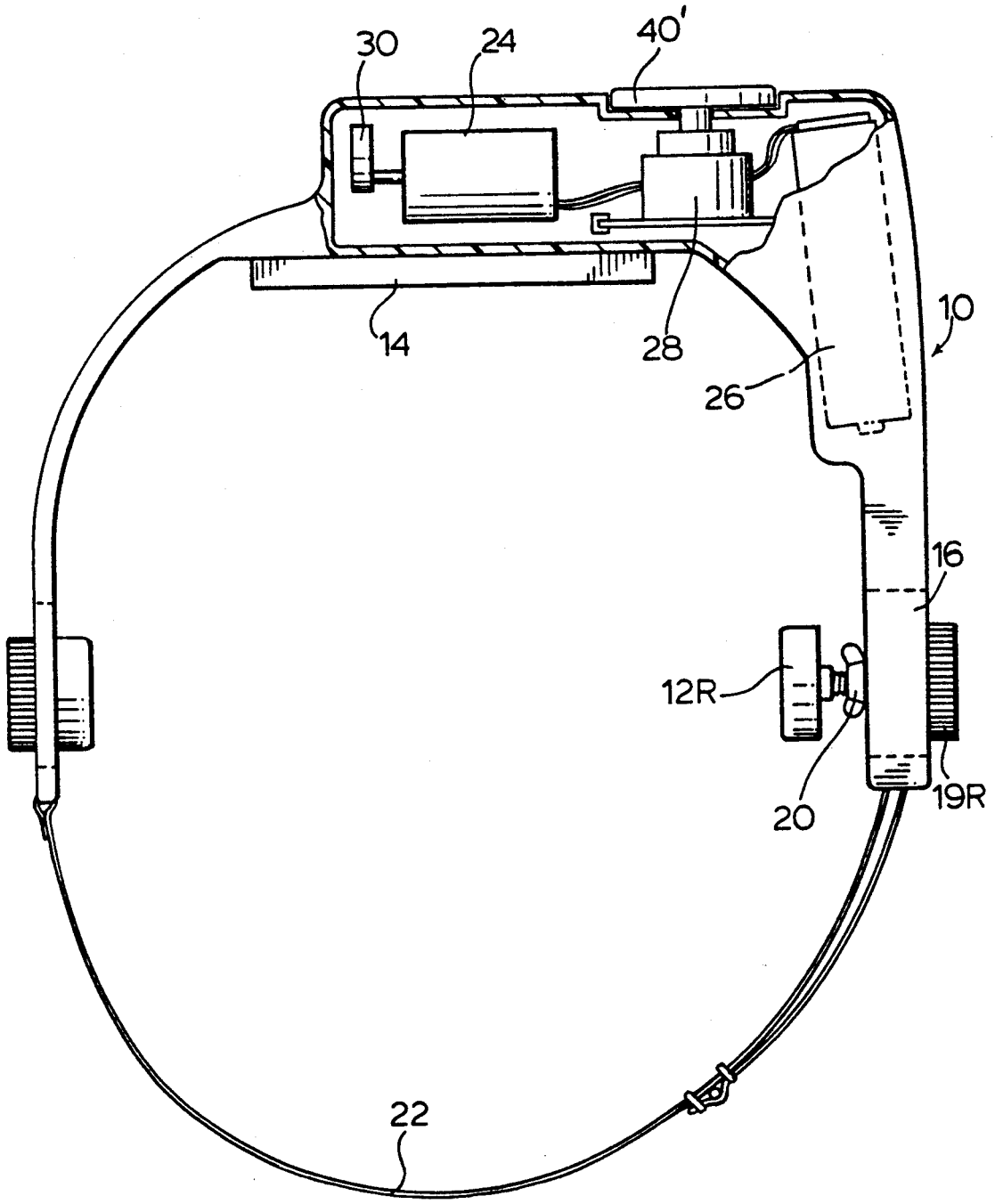
FIG. 2 is a partially schematic plan view of the device.
Figure 3:
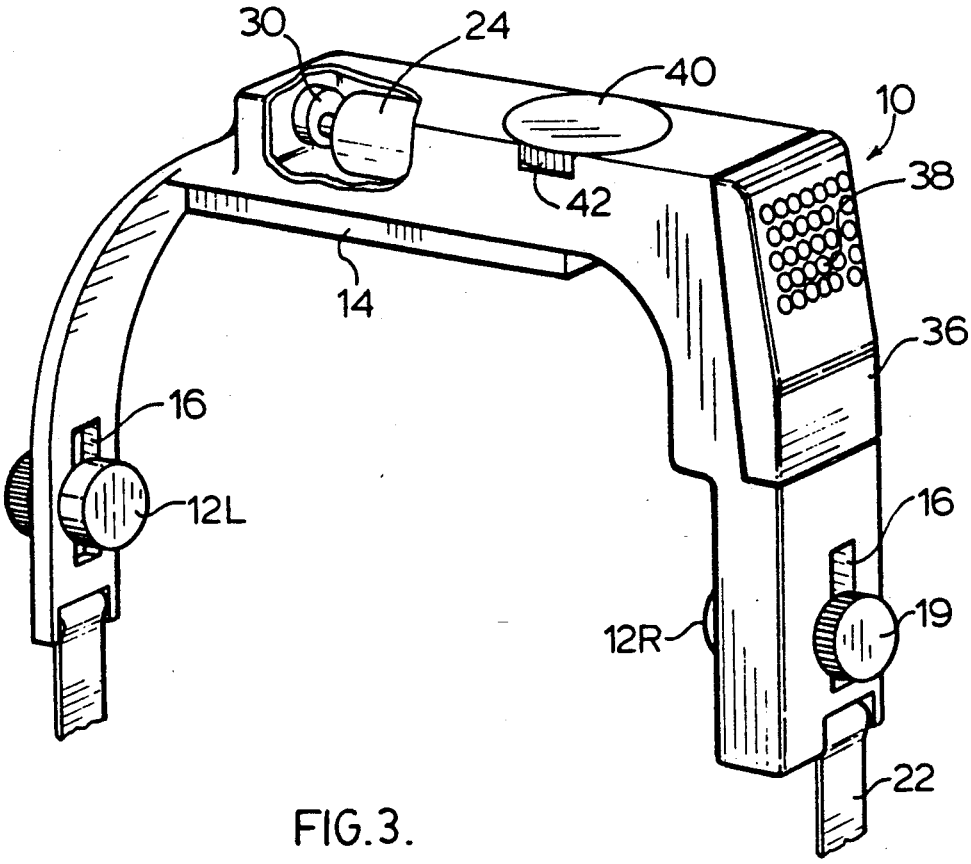
FIG. 3 is a perspective broken away to show the eccentric.

In drawings, a frame 10 defines a general U-shape to extend about the forward part of the head having two arms designed to mount a central, forehead contacting pad 14 of resilient relatively soft foam. The frame 10 is of resilient plastic firm enough to transmit vibrations over its extent.

The temple pads 12 each are preferably made of rubber-coated plastic located to contact the temple. A slot 16 extends longitudually along the frame in the intended vicinity of each pad.

Each pad cooperates with a button 10 which includes a shank 18 extending through and slidable in the slot. The two pads are preferably differently attached. Inside one pad 12R there is threaded a nut 20 on to the shank 18. When the pad 12L is tightened on the shank 18L the pad is clamped to the frame at a selected location along its slot 16. When the pad 12L is loosened on the shank the pad and button may be slid along the slot for location of the pad at the selected position for the pad to contact the user's temple. With the other pad 12R the shank 18R of button 19R extends through the slot to cooperate with the nut 20 on the opposite side of the frame. Thus the nut 20 may be tightened or loosened from clamping relationship with the button 19R, to adjust the pad 12R longitudually along the associated slot 16 to the user's temple location. However the shank 18R extends through the nut to threadedly mount the pad 12R. Thus to adjust the pad longitudually along the slot, the nut may be loosened, the pad and button moved, and then the nut tightened at the selected pad 12R position along the slot. However the spacing of the pad from its opposite pad is controlled by adjustment of pad 12R on shank 18R. Thus the transverse spacing of the pads may be adjusted, but when adjusted and clamped in place are adapted to transmit the vibrations from the frame to the temple.

It is within the scope of the inventional to use alternate means for adjustment of the pads along the frame and for the adjustments of transverse pad spacing.

The central pad 14 is of resilient foam attached by adhesive or otherwise to the frame 10.

A strap 22 of adjustable length is attached to each end of the frame 10 and adjustable at the rear of the head to firmly attach the frame. Such attachment involves partial compression of the central pad so that the user's forehead tends to act like a vibration datum and the vibration is transmitted through the pads 12R and 12L to the user's temples in a massaging action while central pad 14 contracts and expands.

Figure 4:
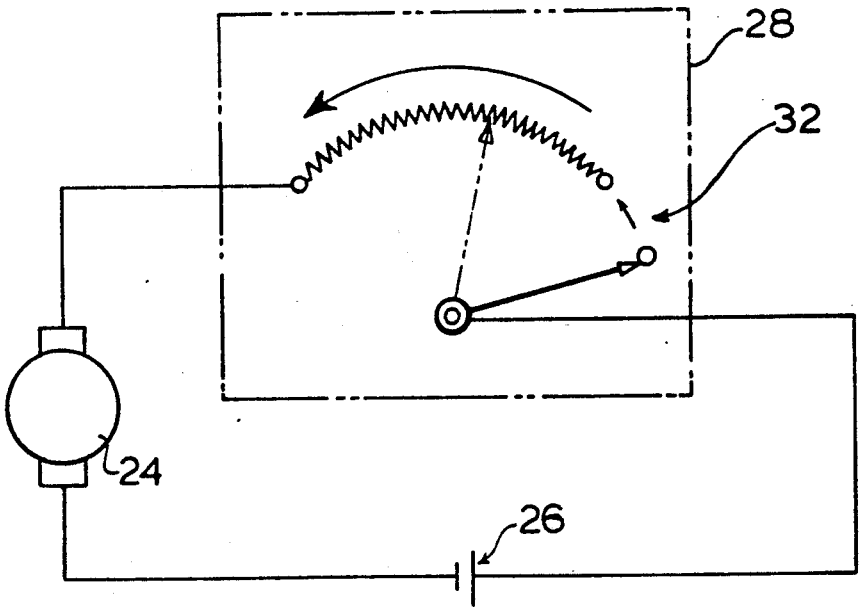
FIG. 4 is a schematic circuit diagram.

Rotating motor 24 battery 26 and speed control 28 are housed in the body of frame 24. A weight 30 is eccentrically mounted on the shaft of motor 24 to provide vibration radially of the motor shaft at frequency determined by the motor speed. There are a number of conventional speed controls which may be used and I prefer to use that shown in the schematic circuit schematically shown in FIG. 4. As shown the electric motor 24 is connected in series with the battery 26 through a combination ON-OFF switch 32 and variable resistor 34 which together form speed control 26. Thus to operate the motor-vibrator, the switch 32 is switched to on and the speed may be adjusted by the same control which reduces or increases the amount of resistance 34 in series with motor and battery to increase or decrease, respectively the vibration speed.

Physically, the motor is mounted in the frame so that the vibrations are transmitted to the frame and so that the rotation axis will be transverse to the users head. This ensures that the direction of vibration will be in radial directions about an axis transverse to the user's head and roughly parallel to the surfaces of contact between the temple pads 12 and the user's temples.

The thickened part of the frame is formed in a general L-shape encompassing the centre of the frame, one side of the front and a portion extending backwardly in that side. The battery 26 is contained in the latter portion and conventional means not shown may be provided for its re-placement. A detachable cover 36 and ornamentation 38 into the frame are schematically shown. The details of the combination ON-OFF switch and variable resistor are not shown as it is conventional but the control knob 40 is mounted to be exposed at the front of the frame. For easy use the top of the frame is interrupted at 42 to allow digital contact with knob 40 at the top of the frame.

In operation the frame 10 is adjusted by (a) moving the temple pads in the slots to the desired position for the user and clamping them there; (b) then adjusting the transverse spacing of the temple pads by adjustment of pad 20R; then (c) adjusting the head strap 22 to attach the frame for the user's head and to partially compress centre pad 14 for resilient spring-like action. To obtain best adjustment steps (a) (b) (c) may have to be repeated cyclically.

The control knob switch 40 is then turned to ON and the setting for best vibrating exposed at 42 on the outside of the central frame, may be adjusted when the vibrator is operating.

With the partially compressed central pad 14 and transverse vibrating axis the user's forehead tends to act as a vibration datum, causing the pads 12R, 12L to tend to vibrate in a closed curve in directions parallel to the surface contact between the pads and the temple and radial relative to the rotation axis. For most users tension relieving effect is produced and it is forward that certain types of headaches are lessened.

I claim:

1. Temple massage device comprising:

a resiliently bendable frame adapted to longitudually extend about the front of the head to locations respectively corresponding to the temple area of the wearer, an adjustable length flexible strap connected to each end of the frame adapted to extend about the rear of the head to maintain said frame in position on said head, means on said frame for contacting the head at the approximately centre of the forehead a means on said frame adapted to contact each temple; rotary vibrating means for causing vibrations in directions radial to an axis transverse to the head of the wearer said means being located at the front of the frame, power unit including battery and motor means for driving said vibrating means located on said frame, wherein means are provided allowing adjusting of said temple contacting means forwardly and backwardly relative to said frame.

2. Temple massage device comprising:

a resiliently bendable frame adapted to longitudinally extend about the front of the head to locations respectively corresponding to the temple area of the wearer, an adjustable length flexible strap connected to each end of the frame adapted to extend about the rear of the head to maintain said frame in position on said head, means on said frame for contacting the head at the approximate centre of the forehead, a means on said frame adapted to contact each temple; rotary vibrating means for causing vibrations in directions radial to an axis, said axis being parallel to a line joining the means to contact each temple, said vibrating means being located at the front of the frame, power unit including battery and motor means for driving said vibrating means located on said frame, wherein said means for contacting the approximate center of the forehead is of a soft material adapted to tend to absorb said vibrations and said temple contacting means is of harder material tending to transmit the vibrations to the temple area, and wherein means are provided allowing adjustment of said temple contacting means forwardly and backwardly relative to said frame.

3. Temple massage device comprising:

a resiliently bendable frame adapted to longitudually extend about the front of the head to locations respectively corresponding to the temple area of the wearer, an adjustable length flexible strap connected to each end of the frame adapted to extend about the rear of the head to maintain said frame in position on said head, means on said frame for contacting the head at the approximate centre of the forehead, a means on said frame adapted to contact each temple rotary vibrating means for causing vibrations in directions radial to an axis, said axis being parallel to a line joining the means to contact each temple, said vibrating means being located at the front of the frame, power unit including battery and motor means for driving said vibrating means located on said frame, wherein there are means mounting one of the temple contacting means on said frame which mounting means incorporates means for adjusting the distance between the temple contacting means.

4. Device as claimed in claim 1 including a speed control for said vibrating means.

5. Device as claimed in claim 2 including a speed control for said vibrating means.

6. Device as claimed in claim 1 wherein means are provided for adjusting the distance between said temple contacting means.

7. Device as claimed in claim 2 wherein means are provided for adjusting the distance between said temple contacting means.

8. Device as claimed in claim 4 wherein means are provided for adjusting the distance between said temple contacting means.

9. Device as claimed in claim 5 wherein means are provided for adjusting the distance between said temple contacting means.

* * * * *